United States Patent [19]

Fujimoto

[11] 4,412,522

[45] Nov. 1, 1983

[54] MAGNET IGNITION DEVICE

[75] Inventor: Takanori Fujimoto, Himeji, Japan

[73] Assignee: Mitsubishi Denki Kabushiki Kaisha, Tokyo, Japan

[21] Appl. No.: 351,221

[22] Filed: Feb. 22, 1982

Related U.S. Application Data

[62] Division of Ser. No. 178,440, Aug. 16, 1980, abandoned.

[30] Foreign Application Priority Data

Aug. 27, 1979 [JP] Japan ..... 54-109497
Aug. 27, 1979 [JP] Japan ..... 54-109498

[51] Int. Cl.[3] ..... F02P 3/12

[52] U.S. Cl. ..... 123/602; 123/599; 123/418; 123/648; 315/209 SC

[58] Field of Search ..... 123/602, 605, 612, 596, 123/599, 648, 626, 418; 315/209 SC, 209 CD

[56] References Cited

U.S. PATENT DOCUMENTS

| | | | |
|---|---|---|---|
| 3,880,133 | 4/1975 | Katsumata | 123/599 |
| 3,898,972 | 8/1975 | Haubner | 123/602 |
| 3,941,110 | 3/1976 | Sekiguchi | 123/599 |
| 3,960,129 | 6/1976 | Hofer et al. | 123/599 |
| 4,273,093 | 6/1981 | Ozawa | 123/602 |

FOREIGN PATENT DOCUMENTS

| | | | |
|---|---|---|---|
| 2431439 | 6/1974 | Fed. Rep. of Germany | 123/605 |
| 51-37242 | 4/1976 | Japan | 123/648 |
| 53-8438 | 1/1978 | Japan | 123/602 |
| 54-153926 | 12/1979 | Japan | 123/418 |
| 55-84863 | 6/1980 | Japan | 123/648 |
| 55-117076 | 9/1980 | Japan | 123/602 |

*Primary Examiner*—Parshotam S. Lall
*Attorney, Agent, or Firm*—Oblon, Fisher, Spivak, McClelland & Maier

[57] ABSTRACT

Disclosed is an ignition device which can provide a good ignition timing characteristic over an engine speed range from low to high by using a first angular signal corresponding to a given crank position of an engine and a second angular signal corresponding to a crank position retarded by a given angle behind the generating position of the first angle signal.

3 Claims, 23 Drawing Figures

MAGNET IGNITION DEVICE

This is a division, of application Ser. No. 178,440, filed Aug. 16, 1980, now abandoned.

BACKGROUND OF THE INVENTION

The present invention relates to a contactless magnet ignition device of the electronic type and, more particularly, to an ignition device for controlling an ignition timing in accordance with the rotation of an engine.

A conventional ignition device of this type drives a semiconductor switching element such as a thyristor or a transistor by an ignition signal produced at the time that an engine is ignited thereby to produce an ignition voltage in the secondary winding of an ignition coil. Accordingly, in the conventional ignition device, an ignition timing is automatically determined by a waveform of an ignition signal produced in synchronism with the rotation of an engine. The ignition timing may be adjustable for an advance angle to prevent the quenching in a low engine speed region, but can not meet the requirement of a delay characteristic for keeping an engine power over an engine speed region from middle to high.

A set of timing charts, shown in FIG. 1, illustrating the operation principle of a known ignition device disclosed in Japan published unexamined patent application No. 36243/77 (52 of Showa) well illustrates particularly a case where the rotational frequency of an engine or an angular velocity $\omega$ of the crankshaft is remarkably reduced.

In FIG. 1, M1 and M2 on a time axis (a) represent two different rotational angular positions of the crankshaft; T a top dead point; S a required ignition angular position. Triangle waveforms lying on a time axis (b) show variations of charging and discharging voltages of the capacitor used in the device of the above-mentioned specification. Vref designates a reference voltage for determining the charging start and the discharging termination. The device is so arranged that the capacitor is charged during a period from the position M1 to the position M2 with a current $i_1$ and following the position M2 it is discharged with a current $i_2$, and at the reference voltage Vref an ignition signal is issued. A curve depicted above and along a time axis (c) shown in FIG. 1 generally illustrates a variation of the rotational angular velocity $\omega$ of the engine.

Let us assume that an angle and a lapse of time between the position M1 and M2 are $\theta 1$ and T1, an angle and a time lapse between positions M2 and S are $\theta 2$ and T2, an angle between positions S and T is $\alpha$, and an angle between the position T and the next position M1 is $\theta 3$. On the assumption, an advance angle $\alpha$ is given by $$\alpha = 180 - (\theta 1 + \theta 2 + \theta 3) \quad (1)$$

In the equation, $\theta 1$ and $\theta 3$ are constant, which are in dependance upon the positions M1 and M2 on the rotational angle axis of the crankshaft, and $\theta 2$ is expressed $$\theta 2 = \bar{\omega} 2 T2 \quad (2)$$

where $\overline{w}2$ is an average angular velocity over time point t2 to t3. Accordingly, the advance angle $\alpha$ may be expressed $$\alpha = K - \bar{\omega} 2 T2 \quad (3)$$

where K is a constant and is given $$K = 180 - \theta 1 - \theta 3 \quad (4)$$

The amounts of the charging and discharging of the capacitor are fixed, so that we have $$i_1 T1 = i_2 T2 \quad (5)$$

T1 may also be expressed $$T1 = \theta 1 / \bar{\omega} 1 \quad (6)$$

From the equations (3), (5) and (6), we have $$\alpha = K - i_1/i_2 \cdot \bar{\omega} 2/\bar{\omega} 1 \times \theta 1 \quad (7)$$

As seen from the equation (7), if $i_1$ or $i_2$ is changed in accordance with a running condition of the engine, the advance angle changes corresponding to the change of the current.

As described above, if the advance angle $\alpha$ is adjusted on the basis of the equation (7), the ratio $\bar{\omega}2/\bar{\omega}1$ is always constant. Let us consider a case where, when a spark is produced at time point t7, for example, it fails to ignite a combustion mixture in the engine cylinder. In this case, the rotational speed of the crankshaft rapidly decreases and a time till the top dead point T and the next angular position M1 are considerably elongated, and further times T1′ and T2′ substantially corresponding to the ignition preparing period of another stroke following the present one is considerably elongated. As a result, if a ratio of an average angular velocity $\bar{\omega}'2$ from time point t10 to t11 to an average angular velocity $\bar{\omega}'1$ from time point t0 to t10, i.e. $\bar{\omega}'2/\bar{\omega}'1$, is smaller than the ratio $\bar{\omega}2/\bar{\omega}1$ in the preceding stroke, the equation (7) shows that, even if the current ratio $i_1/i_2$ is constant, $\alpha$ grows. Therefore, the spark is produced at an angular position S′ far advanced relative to the position S for the required ignition time.

As the rotational speed of the engine is lower, a mixing condition of the intake combustion mixture is generally worse, so that the irregular combustion or the ignition failure is apt to occur, and thus a variation of the rotational frequency is great.

To fix the advanced angle $\alpha$ in low rotational frequencies of the engine crankshaft, even if the charging and discharging currents to and from of the capacitor can be kept constant with the angular velocity $\omega$.

SUMMARY OF THE INVENTION

Accordingly, an object of the present invention relates to a magnet ignition device which overcomes the above-mentioned various disadvantages.

Another object of the present invention is to provide an accurate ignition timing characteristic over a range from a middle engine speed to a high engine speed.

Yet another object of the present invention is to provide a magnet ignition device which if a control circuit associated therewith is disordered, it is impossible to return a control mode of the ignition device to a conventional advance angle control mode by using an ignition signal waveform.

Yet another object of the present invention is to provide a magnet ignition device having an accurate and stable ignition period characteristic, which is free from an instable variation of the ignition timing caused by a violent change of the engine speed in a low engine speed region which is inherent to a conventional ignition device.

To achieve the above objects, the present invention has the following constructions with satisfactory effects.

According to one aspect of the invention, in an engine speed region from middle to high requiring a high accuracy of the ignition timing in order to keep the engine power, an ignition timing is determined by an ignition timing operation circuit in response to a first angular signal. In a low engine speed region requiring a relatively rough accuracy of the ignition timing, the ignition timing is determined by taking advantage of increase of a signal waveform caused by the rotation of a second angular signal, when the engine speed increases, which corresponds to an angular position where the first angular signal is generated and has a wide angular width. Therefore, the ignition device according to the invention may provide an accurate ignition timing characteristic from the middle engine speed to the high one. Further, since the first and second angle signals are generated by a single angle position detector, the construction of the ignition device is simplified.

According to another aspect of the invention, in an ignition timing characteristic required by the engine a delayed angle characteristic is determined by an ignition timing operation circuit in response to a first angular signal with a narrow angle width. The remaining delay angle characteristic is determined by using taking advantage of increase of a signal waveform caused by the rotation of a second angular signal which corresponds to a crank angle delayed by a given angle behind the first angular signal with a wider angle width than the first angular signal. Accordingly, it is possible to obtain a high accuracy delay angle characteristic required for the engine in its output characteristic.

According to yet another aspect of the invention, an ignition device of the invention is comprised of an angular position detecting device for producing a first angular signal with one polarity corresponding to a given crank angle of an engine and a second angular signal with the other polarity corresponding to a crank position delayed by a given angle behind a position where the first angular signal is generated, an ignition timing operation circit which responds to an output voltage of an F-V circuit produced in response to a DC voltage corresponding to the number of a revolutions of an engine and a first angular signal to start an computation of an ignition timing in accordance with an running condition of the engine, a control element for introducing an output signal from the ignition timing operation circuit into the F-V circuit when the number of revolutions of the engine is lower than a given value, a semiconductor switching element which is conductive in response to the output signal from the operation circuit when the number of revolutions exceeds a given value thereby to drive a switching element, and a variable resistor for adjusting a voltage to make the semiconductor switching element conductive. With such a construction, when it is higher than the number of the engine revolution corresponding to a given value of the output voltage from the F-V circuit, the second angular signal and the result of the computation of the ignition computing circuit are applied to the switching element. In a low engine speed region having a violent change of the rotation, only the second angular signal is obtained as an ignition signal. Therefore, there is completely eliminated an instable variation of the ignition timing caused by the violent change of the engine rotation in the low speed region. Therefore, a correct and stable ignition timing may be obtained. Therefore, there is no need for a circuit for selecting either of a signal representing the result of the advance angle computation and the second angular signal. Therefore, the circuit construction is extremely simplified. Further, when the number of revolutions is lower than that corresponding to a given value of the output voltage from the F-V circuit, the supply of the result of the ignition timing operation circuit to the switching element is blocked by the combination of a control element and a variable resistor. Therefore, it is possible to obtain an accurate and stable ignition timing in the low engine speed region. Further, it is possible to change the conductive voltage of the semiconductor switching element by changing a resistance value of the variable resistor. As a result, it is readily adaptable for a change of the advance angle characteristic due to changing the output voltage of the F-V circuit.

DETAILED DESCRIPTION OF THE PREFERRED EMBODIMENTS

Figure 2:
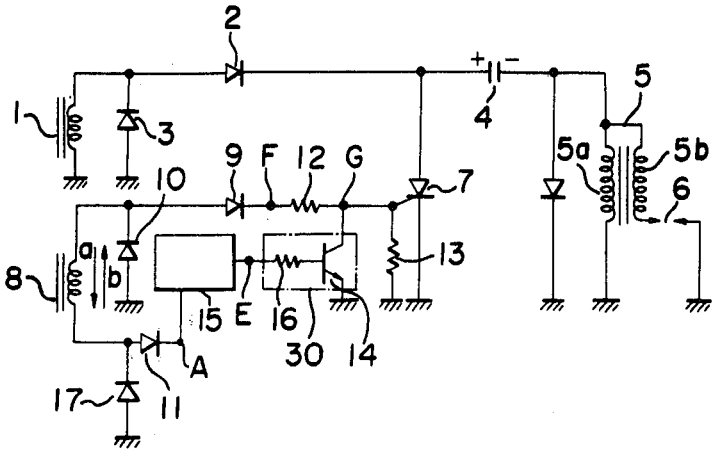
FIG. 2 is a circuit diagram of an embodiment of an ignition device according to the present invention.

Referring now to the drawings and particularly to FIGS. 2 to 7, there is shown an embodiment of a magnet ignition device according to the invention. In FIG. 2, reference numeral 1 designates a generator coil of a magnet (not shown) of a power source which produces an AC voltage alternately changing between positive and negative polarities in synchronism with a rotation of an engine. Reference numerals 2 and 3 designate diodes for rectifying an output signal of the generator coil; 4 a capacitor charged by the output signal of the generator coil 1 after rectified by the diode 2; 5 an ignition coil connected to a discharge circuit of the capacitor 4 having a primary coil 5*a* connected in series with the capacitor 4 and a secondary coil 5*b* connected to an ignition plug 6; 7 a thyristor of a switching element provided in the discharge circuit of the capacitor 4, which permits a charge stored in the capacitor 4 to be discharged into the primary coil 5*a*. A signal coil 8 for generating an ignition signal, as an angular position detector, produces a first angular signal a with one polarity corresponding to a given angular position of the engine crankshaft in synchronism with a rotation of the engine and a second angular signal b with the opposite polarity and a wider angular width corresponding to an angular position of the crankshaft delayed by $\theta$ from the angular position where the angular signal a is produced.

In the position detector circuit, reference numerals 9, 10, and 11 are diodes for preventing backward flow of current; 12 and 13 resistors connected to the gate of the thyristor 7; 14 a transistor so connected to bypass the second angular signal b to ground. 15 an ignition timing operation circuit which starts its operation in response to the first angular signal a to perform the operation of the ignition timing in accordance with a running condition of the engine. The output of the circuit 15 is connected to the base of the transistor 14 by way of a resistor 16. The combination of the resistor 16 and the transistor 14 forms a circuit 30 for controlling the bypass of a second angular signal b with the opposite polarity in the signal coil 8. The circuit 15 is illustrated in detail in FIG. 4.

Figures 3, 4, 5:
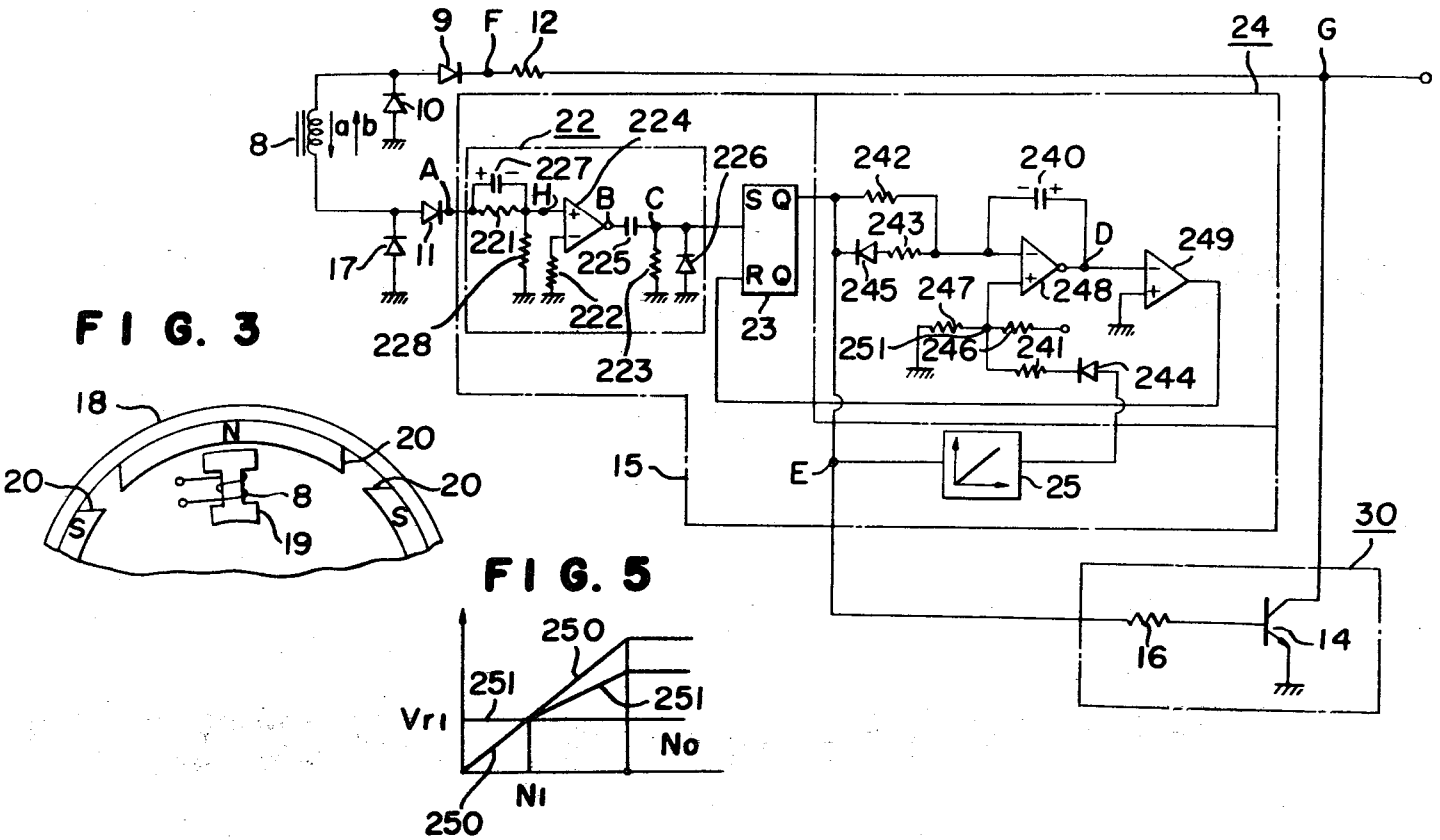
FIG. 3 is a front view of a structure of an angular position detection device used in the embodiment shown in FIG. 2.
FIG. 4 is a circuit diagram of a detailed circuit construction of the embodiment shown in FIG. 2.
FIG. 5 is a diagrammatical illustration of an output characteristic of an F-V circuit used in FIG. 4.

FIG. 3 schematically illustrates a structure of the angular position detector for producing first and second angular signals a and b. A flywheel 18 of a magnet generator tubularly has four permanent magnets 20 attached onto the inner peripheral surface thereof which are juxtaposed with different polarities. Reference numeral 19 is representative of a stator core axially disposed facing the permanent magnets 20 with a clearance intervening therebetween. The stator core 19 is wound therearound by the signal coil 8. With the rotation of the flywheel 18, it developes signal voltages a and b in FIG. 2 in the signal coil 8.

Turning now to FIG. 4, there is shown a circuit diagram of the ignition timing operation circuit 15. In the circuit, numeral 22 denotes a wave shaper for wave-shaping an output signal from the signal coil 8; 221 to 223 and 228 resistors; 224 a voltage comparator (referred to as a comparator); 225 and 227 a capacitors; 226 a diode; 23 a flip-flop circuit; 24 an operation circuit connected to the flip-flop circuit to produce a given output signal in accordance with the number of revolutions of the engine; 241 to 243 and 246 and 247 resistors; 244 and 245 diodes; 240 a capacitor; 248 an operational amplifier (referred to as an opamp); 25 a rotational-frequency to voltage converting circuit (referred to as an F-V circuit) which receives the output signal a of the signal 8 coil wave-shaped as a rotational-frequency signal and produces a DC voltage proportional to the number of revolutions.

The flip-flop circuit 23 is connected at one input terminal S to the wave shaping circuit 22 and at the other input terminal R to the output of the comparator 249. One of the output terminals denoted as Q, of the flip-flop circuit 23 is connected to the inverted input terminal (referred to as a (−) terminal) of the opamp 248 by way of a series circuit of the diode 245 and the resistor 243.

The non-inverted input terminal (referred to as a (+) terminal) of the opamp 248 is connected to an output terminal of the F-V circuit 25, through a resistor 241 and diode 244, and is also biased by a voltage of a power source divided by the resistor 246 and 247. The output terminal of the opamp 248 is connected to the (−) terminal of the comparator 249, and also to the (−) terminal of the opamp 248 through a capacitor 240. The non-inverted input terminal (+) of the comparaor 249 is connected to ground.

FIG. 5 graphically illustrate an output characteristic of the F-V circuit 25, with a straight line 250 representing an example of the characteristic, changing linearly. As shown in FIG. 5, the characteristic is obtained with a voltage Vr1 for the rotational frequency N1 being equal to a bias voltage Vr1 of the comparator 249. The voltage at the (+) terminal of the opamp 248 changes as plotted by a characteristic curve 251.

Figure 1:
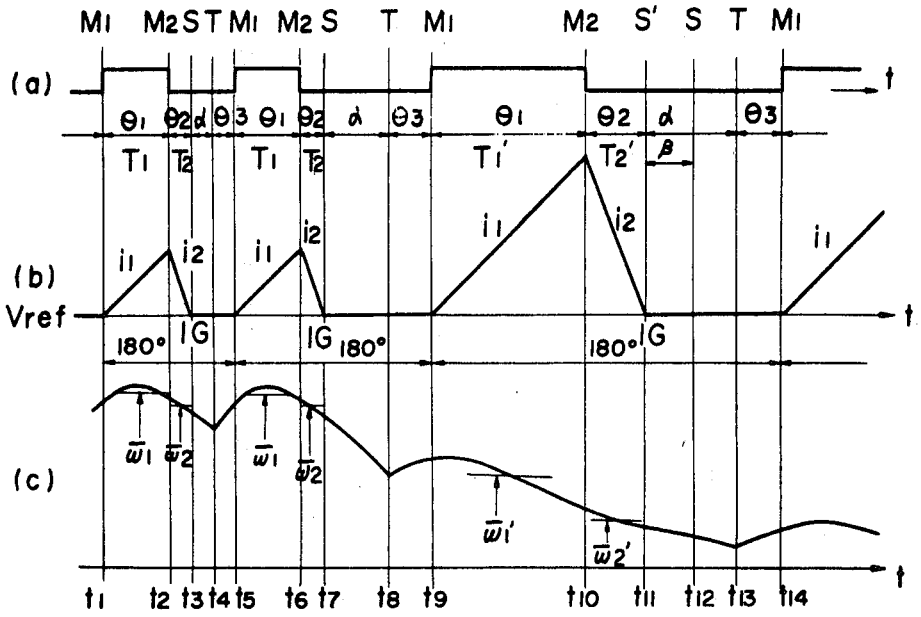
FIG. 1 is a set of timing diagrams useful in explaining the operation of a conventional ignition device.
Figure 6:
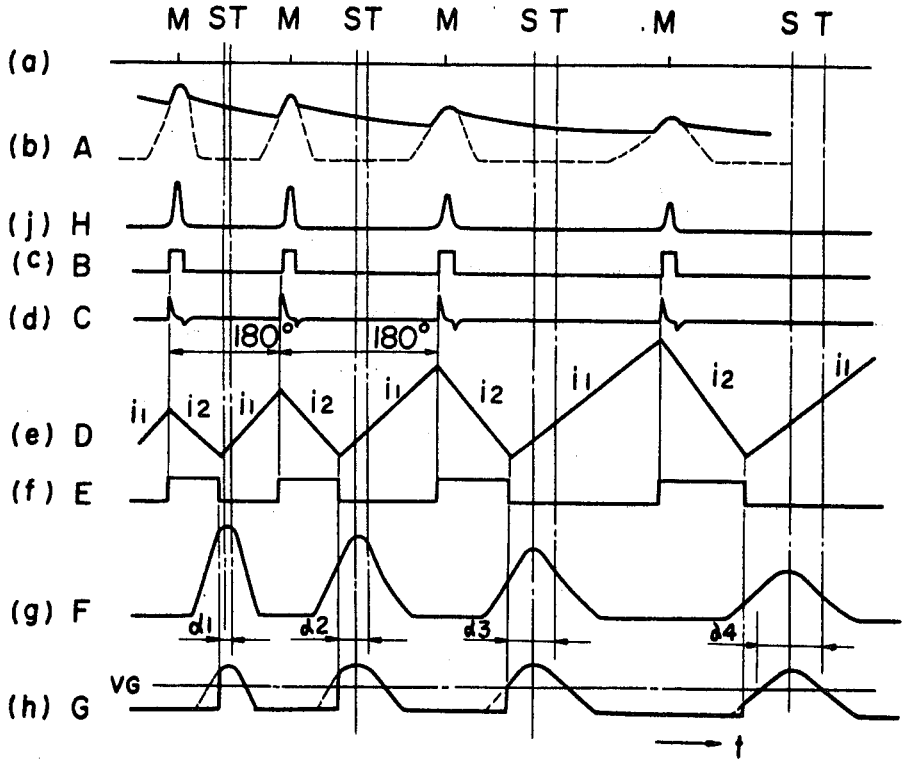
FIG. 6 is a set of waveforms useful in explaining the operation of the embodiment shown in FIG. 2.

In FIG. 6, there are arranged time lines (b) to (j) with time charts of voltages A to H at the respective portions in FIG. 4; a time line (a) a time chart with symbols representing angular positions of the crankshaft arranged thereon; M an angular position slightly leading the most advanced angular position required by the engine and to produce the first angular signal; S an ignition position to produce the second angular signal; T a top dead point as in FIG. 1.

The explanation to follow is for the operation of the embodiment thus constructed. In the magnet ignition device of the CDI type shown in FIG. 2, the rectified output signal from the power source coil 1 charges the capacitor 4 with the polarities as shown in the figure. A charge stored in the capacitor is applied to the primary coil 5*a* of the ignition coil 5 at the time that the engine is ignited, that is, at the time that the ignition timing operation circuit 15 with the output voltage a of the signal coil 8 as its input signal produces an output signal or that the output voltage b of the signal coil 8 is produced, upon the conduction of the thyristor 7, thereby causing a high voltage in the secondary coil 5*b* and the ignition plug 6 to produce a spark.

The adjusting means of the conduction timing of the thyristor 7, or the ignition timing, will be described in detail, together with an advance angle characteristic curve shown in FIG. 7.

Figure 7:
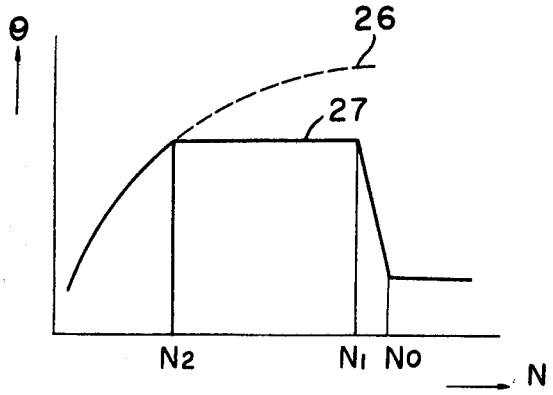
FIG. 7 is a graphical representation of an advance angle characteristic of the embodiment shown in FIG. 2.

Let it be assumed that the engine runs at a fixed rotational frequency higher than that N1 shown in FIG. 7 but lower than N0 and the spark advance angle at that time is not zero and leads by angle $\alpha$ from a position T. On this assumption, the ignition device shown in FIGS. 2 and 4 will operate in the following manner.

The F-V circuit 25 counts or integrates an output voltage corresponding to a rotatioal frequency of the engine to produce an output voltage 250 higher than the bias voltage Vr1. The output voltage 250 is applied to the opamp 248 as its input voltage. The (+) terminal voltage of the operational amplifier 248 changes with the engine rotation, as illustrated in FIG. 5.

The flip-flop circuit 23 is set at the leading edge of a high level of the output voltage C at the position M to produce the output voltage E at a high level. When the output voltage E becomes a high level, the capacitor 240 charged with the polarities as shown in FIG. 4 starts to discharge with a current $i_2$ given by the following equation.

$i_2$=high level output voltage of flip-flop 23 (+) terminal voltage (251) across the opamp (248)/resistance of resistor 242 (8)

As seen from the above equation, a magnitude of the discharge current $i_2$ depends on the output (+) terminal voltage 251 of the opamp 248, if the resistance of the resistor 242 is constant. In this region, it depends on the output voltage 250 of the F-V circuit 25. Specifically, with increase of the rotational frequency of the engine, the discharge current $i_2$ becomes small, the inclination of the characteristic curve becomes gentle, and an angular width of the output voltage E at high level from the flip-flop 23 becomes wide. The angular width of the output voltage E at high level, thus obtained, corresponds to the result of the operation by the operation circuit 24.

The output voltage D of the opamp 248 descends as shown in FIG. 6 to reach zero volt, so that a positive pulse voltage appears at the output of the comparator 249. The positive pulse voltage becomes a reset input signal of the flip-flop 23. When the flip-flop circuit 23 receives the reset pulse at the input terminal R, it is reset to produce the output voltage E of a low level.

In this manner, the output voltage E of the flip-flop circuit 23 becomes low in level. In turn, charging the capacitor 240 of FIG. 4 in the polarity direction with the current $i_1$ expressed by the following relation, commences.

$i_1$=(+) terminal voltage 251 of the opamp 248−voltage drop of the diode 245/resistance of resistor 243+(+) terminal voltage 251 of the opamp/resistance of resistor 242 (9)

As seen from the above equation, an amplitude of the charging current $i_1$ depends on the (+) terminal voltage 251 of the opamp 248 if the resistances of the resistors 243 and 242 are constant. In this region, it depends on the output voltage 250. As the rotational frequencies increases, the charging current $i_1$ grows and the inclination of the current characteristic becomes steep. As described above, with the increase of the rotational frequency, an angle width of the high level output voltage E from the flip-flop 23 becomes wider.

The output voltage E of the operation circuit 15 obtained through the above-mentioned operation is supplied through the resistor 16 to the base of the transistor 14. The collector of the transistor 14 is so connected to bypass the output signal b from the signal coil 8 to ground. With this circuit arrangement, a positional interrelation among signals A, H and F causes a gate signal of the thyristor 7 to take a waveform G shown in FIG. 4.

In the rotational region where the rotational frequency is between No and N1, with increase of the rotational frequency, the falling time point of the high level output voltage E of the flip-flop 23 is delayed, so that the conduction time point of the thyristor 7 is retarded. As a result, the igntion timing point is delayed with increase of the rotational frequency. When the rotational frequency of the engine reaches No, the output voltage 250 of the F-V circuit 25 and the (+) terminal voltage 251 of the operational amplifier 251 are constant. Accordingly, the falling time point of the high level output voltage E of the flip-flop 23 is fixed irrespective of the increase of the rotational frequency of the engine. As a result, the ignition time point of the engine also is fixed.

When the output voltage B becomes again high in level at the angular position M in the rotational frquency region lower than the rotational frequency N1 but higher than N2 shown in FIG. 7, the flip-flop circuit 23 is set as mentioned above and, the capacitor 240 discharges. The output voltage 250 of the F-V circuit 22 is lower than the bias voltage Vr1. Therefore, even if the transistor 216 is turned on, the output voltage 250 of the F-V circuit 25 doesn't affect the discharge current $i_2$ which is given by the following equation $i_2$=((output voltage E of a high level of flip-flop)−Vr1/resistance of resistor 242 (10)

The above equation shows that, in this region, a magnitude of the discharge circuit $i_2$ is constant irrespective of the rotational frequency and that the charging current $i_1$ as given by the following equation is constant independent of the rotational frequency.

$i_1$=Vr1−voltage drop across the diode 245/resistance of the resistor 243+Vr1/resistance of the resistor 242 (11)

Accordingly, the conduction time points of the transistor 4 and the thyristor 7 are also fixed independently of the rotational frequency of the engine, and further the ignition timing is fixed.

In an engine speed region lower than the rotational frequency N2 shown in FIG. 7, the discharging current i2 and the charging current i1 of the capacitor 240 caused by the output voltage a of the signal coil 8 become fixed, as in the above-mentioned case. An angular width of the high level output voltage E of the flip-flop circuit 23 is constant irrespective of the number of revolutions.

The output voltage b of the signal coil 8 is small, as shown in FIG. 6(G) since the number of revolutions is small. Therefore, even if the transistor 14 is bypassed by the output E of the operation circuit 15, the voltage at a point G does not reach the conduction voltage $V_G$ of the thyristor 7. Thus, the result of the operation in the operation circuit 15 does not contribute to the ignition. Therefore, when the output voltage b of the signal coil 8 reaches the conduction voltage $V_G$ of the thyristor 7, the thyristor 7 conducts to ignite the engine.

Consequently, in such a low engine speed region, only the output signal b of the signal coil 8 with a wide angle width contribute to the conduction of the thyristor 7, so that an advance angle characteristic denoted as 26 is obtained as shown in FIG. 7. This is for this reason that the signal with a wide angle width grows with increase of the engine speed.

Through the operation as mentioned above, an advance angle characteristic is obtained as indicated by a continuous line denoted as 27 in FIG. 7. Specifically, in the engine speed region less than N2, an angle advances with growth of the waveform E of the output voltage b from the signal coil 8. In the engine speeds more than N2, when the the output voltage b of the signal coil 8 is below the threshold level ($V_G$) of the output waveform F, it is bypassed during the entire period of a high level by the high level state of the output signal E given by the result of the operation. Accordingly, the ignition time is positioned at the pulse falling time of the output signal E obtained by the operation result of the operation circuit 15, that is to say, at a point where the level is changed from high to low.

Figure 8:
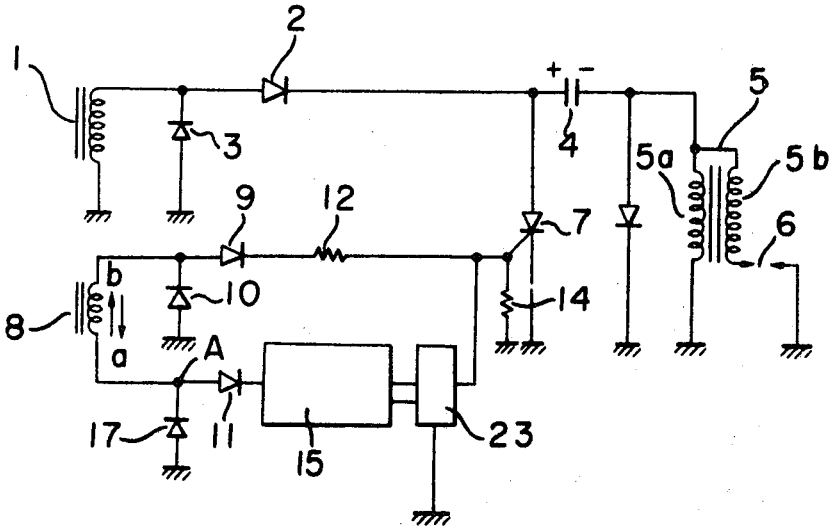
FIG. 8 is a circuit diagram of another embodiment of the ignition device according to the present invention.
Figure 9:
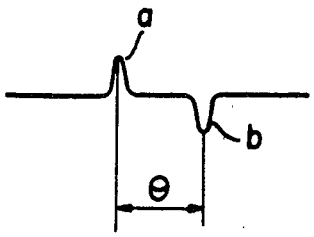
FIG. 9 is a waveform for illustrating the operation of a part of the circuit shown in FIG. 8.

Another embodiment of the ignition device according to the present invention will be described referring to FIGS. 8 to 14. In FIG. 8, an ignition timing operation circuit 15 responds to the first angular signal a produced by the angular position detecting device 8 which leads the second angualr signal b by $\theta$ as shown in FIG. 9, thereby to start the operation to compute a running condition of the engine. 26 designates a pulse falling sensing circuit for applying the result of the operation by the operation circuit to the gate of the thyristor 7 only when it is above the number of the rotations of the engine.

Figures 10, 11:
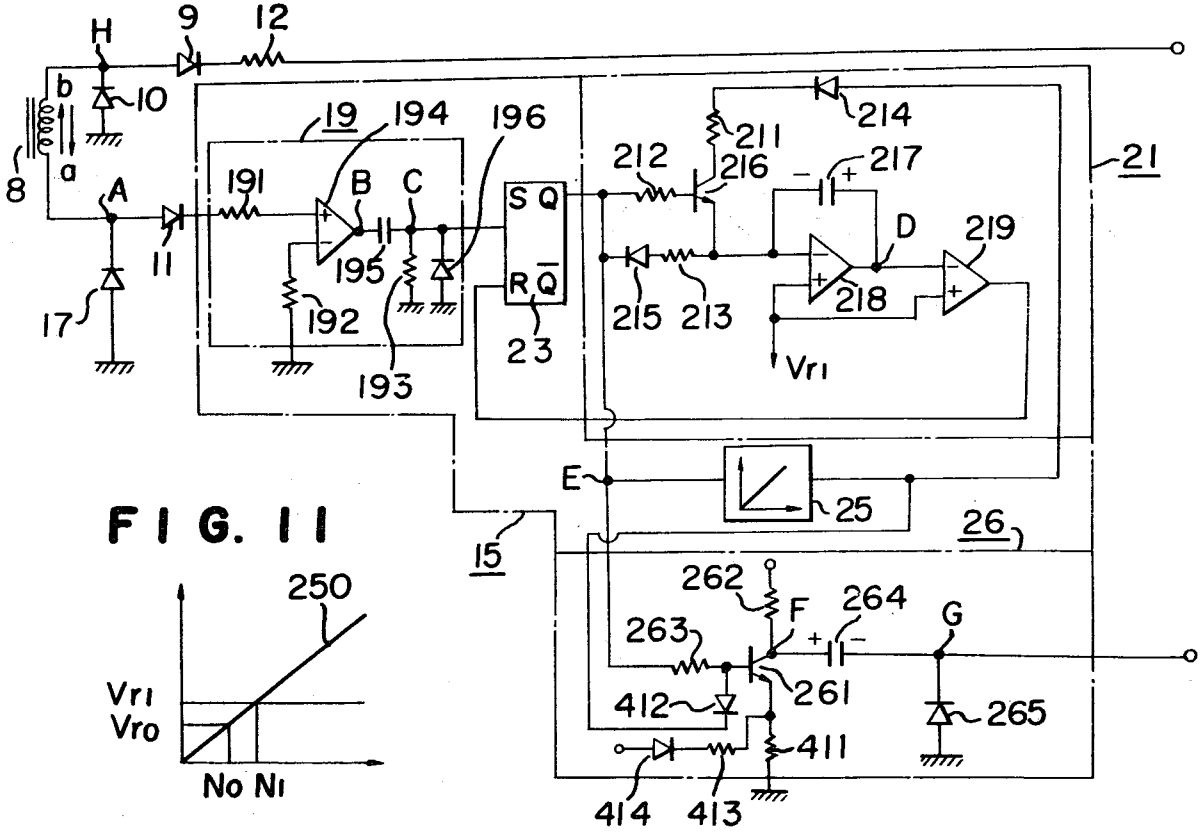
FIG. 10 is a circuit diagram of a detailed circuit construction of the embodiment shown in FIG. 8.
FIG. 11 is a graphical representation of of an output characteristic of the F-V circuit used in the circuit shown in FIG. 10.

In FIG. 10 illustrating a detailed circuit construction of the ignition timing operation circuit 15 and the pulse falling sensing circuit 26, reference numeral 19 designates a wave shaping circuit for wave-shape the output signal of the signal coil 8; 191, 192 and 193 resistors; 194 a voltage comparator (referred to as a comparator); 195 a capacitor; 196 a diode; 21 an operation circuit connected to a flip-flop circuit for producing a given output signal in accordance with the rotational frequency of the engine; 214 and 215 diodes; 216 a transistor; 217 a capacitor; 218 an operational amplifier (referred to as an opamp); 25 a rotational frequency to voltage converting circuit (F-V circuit) which receives a wave-shaped output signal of the output signal a from the signal coil 8 as a rotational frequency signal and converts the signal into a DC voltage proportional to the rotational frequency.

An input terminal of the flip-flop circuit 23 is connected to the wave-shaping circuit 19 while the other input terminal R is connected to the output of the comparator 219. One output terminal(Q) of the flip-flop circuit 20 is connected through the resistor 212 to the base of the transistor 216 and through a series circuit of the diode 215 and the resistor 213 to the emitter of the transistor 216. The collector of the transistor 216 is connected through the resistor 211 and the diode 214 to the output terminal of the F-V circuit 25. The emitter of the transistor 216 is connected to the inverted input terminal (referred to as a (−) terminal) of the opamp 218. The output terminal of the opamp 218 is connected to the (−) terminal of the comparator 219 and through the capacitor 217 to the (−) terminal of the opamp 218 per se. The non-inverted input terminals (+) of the operational amplifier 218 and the comparator 219 are biased by the comparing voltage Vr1. A pulse falling sensing circuit 26 senses a given output pulse corresponding to the result of the operation from the operation circuit 21 and sends an output signal to the gate of the thyristor 7. A transistor 261 as a semiconductor switching element is connected at the base to one output terminal Q of the flip-flop circuit 20 through the resistor 263, at the collector to the power source through the resistor 262, and at the emitter to ground through a resistor 411. Reference numeral 264 is a capacitor connected to the collector of the tansistor 261 and 265 designates a discharge diode. In accordance with ON and OFF of the transistor 261, the combination of the resistor 262, the capacitor 264 and the diode 265 controls the conduction of the thyristor 7. A diode 412 as a control element is connected to the connection point between the base of the transistor 261 and the resistor 263 and the output side of the F-V circuit 25. A variable resistor 413 is connected at one end to the connection point between the emitter of the transistor 261 and the resistor 411 and at the other end to a diode 414. The variable resistor 413, together with the resistor 411, forms a voltage divider. The anode of the diode 414 is connected to the power source. A potential at the connection point between the emitter of the transistor 261 and the voltage dividing resistors 411 and 413 is selected to be equal to the output voltage Vro of the F-V circuit 25 to be described later. The Vro also is a voltge to render the transistor 261 conductive. FIG. 6 shows an output characteristic of the F-V circuit 25 which changes rectilinealy as indicated by a line 250. The characteristic, as shown in FIG. 11, has a voltage equal to the bias voltage Vr1 of the comparator 219 when the rotational number is N1. When the engine speed is above the No, the output signal from the F-V circuit 25 is higher than the connection point voltage Vro (the conduction voltage of the transistor 261) of the voltage dividing resistors 411 and 413, the output signal from the operation circuit 21 is not led to the F-V circuit 25 but to the base of the transistor 261. For this reason, the transistor 261 is turned on. When the engine speed is lower than No, the output signal from the F-V circuit 25 is lower than Vro, the base potential of the transistor 261 is lower than the connection point potential of the voltage dividing resistors 411 and 413. Therefore, the output signal from the operation circuit 21 enters the V-V circuit 22, through the resistor 263 and the didoe 412, so that the transistor 261 keeps its OFF state.

Figure 12:
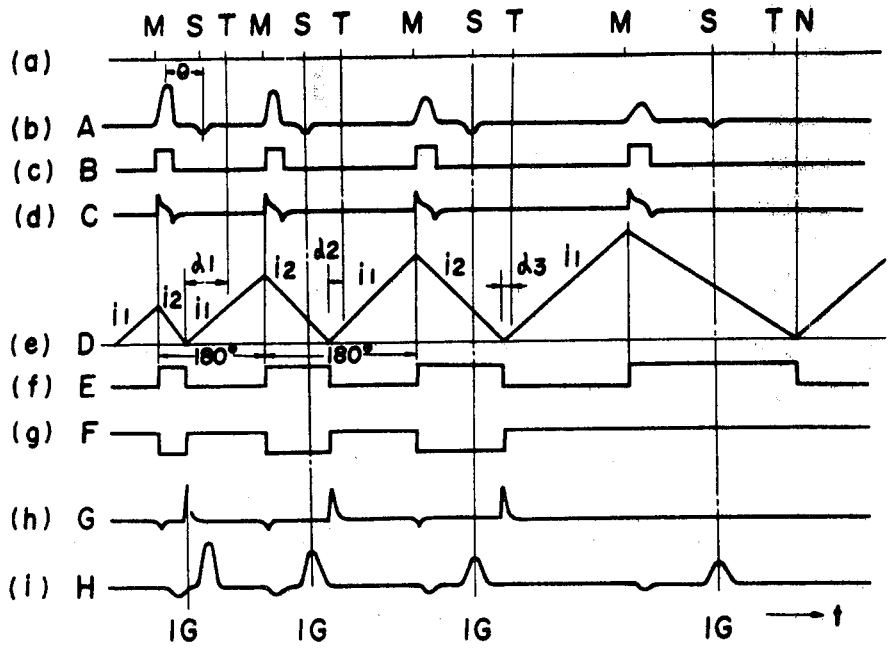
FIG. 12 is a set of waveforms useful in explaining the operation of the embodiment shown in FIG. 8.

In FIG. 12, time lines (b) to (i) represent time charts of voltages A to H at the respective portions in the circuit in FIG. 10. Of those lines, the time line (a) is a time chart providing symbols of crank angular positions in which a symbol M designates an angular position leading slightly the most advanced angular position required by the engine, S is an igniting position required in a low speed, and T a top dead point, as in FIG. 1. The output voltage a produced from the signal coil 8 corresponding to the rotation of the engine is high at the point M and low at the point S, as shown in FIG. 12.

Figure 13:
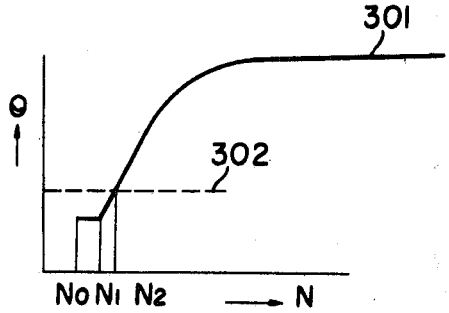
FIG. 13 is a graphical representation of the advance angle characteristics of the circuit of FIG. 10.

The explanation to follow is elaboration of the conduction timing of the thyristor 7 or the adjusting mean for the ignition timing, and the advance angle characteristic curve shown in FIG. 13 as well.

Assume now that the engine runs at an engine speed higher than the number of revolutions N2, and that in this case, the ignition advance angle is not zero but leads the position T by an angle alpha. On the assumption, the operation of the circuit shown in FIGS. 8 and 10 is as described below.

Firstly, the F-V circuit 25 counts or integrates the output voltage corresponding to the number of revolutions of the engine. The output voltage from the F-V circuit 25 is higher than the bias voltage Vr1, serving as an input voltage to the comparator 219 and as a collecotr supply voltage to the transistor 216.

The flip-flop circuit 23 is set by the high level of the output voltage C at the position M. The output voltage E from the flip-flop circuit 23 is at high level. When the output voltage E is at high level, the transistor 216 is forwardly biased to be turned on. Upon the turning on of the transistor 216, the capacitor having been charged with the voltage polarity as shown in FIG. 10 starts to discharge with a current i2 given by the following equation i2=(F-V output voltage 250)−Vr1−voltage drop across diode 214/resistance of the resistor 211+output voltage of high level from the flip-flop−Vr1−voltage drop between the B-E path of the transistor 216/resistance of the resistor 212 (12)

As seen from the above equation, the magnitude of the discharge current i2 depends on the output voltage 250 of the F-V circuit 25 if the resistances of the resistors 211 and 212. Upon commencing the discharge of the capacitor 217, the output voltage D from the opamp 218 descends as shown in FIG. 12 to reach the bias voltage Vr1. At this time, a positive pulse voltage appears at the output of the comparator 219 and serves as a reset input signal.

When receiving at the input terminal R, the flip-flop circuit 23 is reset, so that the output voltage E becomes a low level.

The output$voltage E of high level thus obtained corresponds to the operation result of the operation circuit 21.

When the output voltage from the flip-flop circuit 23 becomes high level, base current is fed to the transistor 261 of the negative-going detecting circuit 26. The output voltage of the F-V circuit 25 has a value larger than Vro and the voltage 250 exceeds the conduction voltage of the transistor 261. The output voltage E of the operation circuit. Therefore, a signal caused by the output voltage E of the operational amplifier 21 is applied through the resistor 263 to the base of the transistor 261 to thereby turn on the transistor 261. With this, charge stored in the capacitor 264 with the polarity as shown discharges through the transistor 261, the resistor 411 and the diode 265. The output voltage F becomes low in level and the output voltage dropped across the diode 265 appears at a point G. When the output voltage E of the flip-flop circuit 23 changes from high level to low, no base current is fed to the transistor 261. Accordingly, the transistor 261 is turned off and the capacitor 264 is charged through a resistor 262 from the power source, with the polarity as shown. With this, the power source terminal voltage F becomes high in level and a large trigger voltage as shown in FIG. 12 occurs, so that the trigger voltage is applied to the gate of the thyristor 7.

In this way, the output voltage E from the flip-flop circuit 23 becomes low in level and the transistor 216 is turned off. The turning off of the transistor 216 removes the application of the output voltage 250 of the F-V circuit 25 to the non-inverted input terminal of the operational amplifier 218. As a result, the output voltage D of the operational amplifier 218 increases. Accordingly, the charging into the capacitor 217 with a current i1 with the polarity as shown and given by the following equation.

*i*1=Vr1−voltage drop across the diode 215/resistance of the resistor 213 (13)

As seen from the above equation, the magnitude of the charging current i1 is constant irrespective of the rotational frequency. Accordingly, the charging voltage of the capacitor 217, that is, the output voltage D of the opeamp 218, have a triangle waveform with rectilinear segmental inclinations irrespective of the number of the rotations as shown in FIG. 12.

In the engine speed region where the engine speed is lower than N2 but higher than N1, the output voltage B becomes again high in level at the angular position M, the flip-flop circuit 23 is set as in the previous case, the capacitor 217 is discharged and the output voltage E of the operation circuit 21 becomes high in level. At this time, however, the output voltage 250 of the F-V circuit 25 is lower than the value in the previous cycle and a magnitude of the discharging current i2 is small as given by the equation (8). Accordingly, more time than in the previous cycle is taken till the voltage across the capacitor 217, or the output voltage D of the opeamp 218, reaches the bias voltage Vr1. As shown in FIG. 12, it reaches at an angular position retarded behind the required igniting position S, or advanced by alpha 2 from the top dead point T, so that the output voltage E becomes low in level. In this engine speed region, the output voltage 250 of the F-V circuit still have a value larger than a valve Vro and the conduction voltage of the transistor 261. Accordingly, when the output voltage E of the flip-flop circuit 23 becomes low in level, the transistor 261 shifts from ON to OFF and the output voltage F becomes high in level. Therefore, the output voltage G becomes a trigger pulse at an angular position delayed behind the set angular position S, as shown in FIG. 12, which in turn is applied to the gate of the thyristor (7).

This angular position is the one advanced by an angle alpha 2 from the top dead point T.

In an engine speed region between N1 and No shown in FIG. 13, when the output voltage B becomes again high in level, the flip-flop 23 is set as in the previous case and the capacitor 217 is discharged. At this time, as seen from FIG. 11, the output voltage 250 of the F-V circuit 25 is lower than the bias voltage Vr1. For this reason, although the transistor is turned ON, the output voltage 250 of the F-V circuit 25 does not contribute to the discharge current i2, and the current 12 is given by

*i*2=(output voltage E of high level from the flip-flop)−Vr1−the voltage drop between the B-E path of the transistor 216/resistance of the resistor 212 (14)

As seen from the above equation, in this engine speed region, the discharge current i2 is fixed irrespective of the number of revolutions. The charging current i1 also is constant irrespective of the rotational number, as previously stated. In this region, the output voltage 250 of the F-V circuit 25 reaches the conduction voltage Vro, so that the ON and OFF of the transistor 261 are controlled by the output voltage E and that an angular position where the output voltage E of the flip-flop 23 becomes low in level, that is to say, where a trigger pulse supplied to the gate of the thyristor 7 occurs, is always earlier than the top dead center T by alpha 3.

In the engine speeds lower than the No shown in FIG. 13, the output voltage B becomes again high in level at the angular position M, the flip-flop 23 is set and the capacitor 217 is discharged. In this engine speed region, the charging current i1 and the discharging current i2 are constant irrespective of the number of revolutions of the engine. Accordingly, the output voltage E of the flip-flop 23 becomes low in level again through the discharge of the capacitor 217. In this engine speed region, however, the output voltage 250 of the F-V circuit 25 is lower than the emitter potential (conduction voltage Vro) of the transistor 261. For this reason, th output voltage E of the operation circuit 21 is not applied to the base of the transistor 261 and flows into the F-V circuit 25 through the resistor 263 and the didoe 412. For this reason, the transistor 261 keeps the OFF state when the engine speed is lower than the No. Accordingly, even though the output voltage E has been shifted from high level to low, the output voltage F keeps the high level state, so that no trigger pulse to the gate of the thyristor 7 occurs at the position G.

Through the above-mentioned operation, when only the output signal of the ignition timing operation circuit 15 under control of the negative-going detecting circuit 23 is applied to the gate of the thyristor 7, the advance angle characteristic is as plotted by a continuous line 301 in FIG. 13. When only the output signal b of the signal coil 8 is applied to the gate of the thyristor 7, the advance angle characteristic obtained is as poltted by a broken line 302 in FIG. 13. Here, let us consider a case where the output voltage H by the output b of the signal coil 8 and the output voltage G computed by the output signal a from the signal coil a are continuously applied to the gate of the thyristor 7. When the number of the revolutions of the engine exceeds No, either the signal voltage G or G which is earlier applied to the gate of the thyrsistor 7 causes the charge charged in the capacitor 4 to enter the ignition primary coil 5*a* thereby to induce a high voltage in the ignition secondary coil 5 and to spark in the ignition plug. Accordingly, even if the signal G or H coming later reaches the gate of the thyristor 7 and the thyristor is turned on, no high voltage is induced in the ignition coil 5 since the capacitor 5 has been discharged already to have no charge therein. In the engine speeds lower than No, the output a of the signal coil 8*a* is computed by the operation circuit 15. The OFF state of the transistor 261 kept blocks the application of the operation result to the gate of the thyristor 7. That is, only the signal H by the output signal b of the signal coil 8 is applied to the gate of the thyristor 7. Accordingly, the signal H turns on the thyristor 7 to discharge the capacitor 4 to contribute to the spark. In brief, in the engine speeds higher than N2 shown in FIG. 12, the ignition occurs at an angular position earlier than the top dead point T by alpha 1 or more. On other hand, in the engine speeds lower than the N2, it occurs at the position S shown in FIG. 12.

Let us consider a case where in the above-mentioned operation, after the spark occurs at the position S, the engine fails to ignite a combustion mixture by some cause.

Such a failure of ignition is apt to occur in low rotational frequencies and is caused by a variation of the mixture ratio of the mixture. In the ignition failure, the engine speed decreases below N0 and the rotational angular frequency of crank rapidly decreases to remarkably elongate a time taken until it reaches the next position M. Since charging current $i_1$ to the capacitor 217 is constant as seen from the equation (13), the charging voltage D, i.e., the output voltage D of the opeamp 218 is high, compared to that of the previous cycle, however. In this way, the output voltage B becomes high in level at position M after the ignition failure. At this time, the flip-flop circuit 23 is set as in the previous cycle and the capacitor 217 becomes in a discharge condition. Under this condition, the discharge of the capacitor 217 progresses with a discharge current $i_2$. With the discharge, the output voltage D reaches the bias voltage Vr1 at a the position N2 advancing relative to the top dead point T. At this point, the output voltage E drops to low level. At this time, however, the transistor 261 is OFF and the output voltage F becomes high, so that the output voltage G does not become the trigger pulse and never renders the thyristor 7 conductive. Accordingly, in this engine speed region, only the output b of the signal coil 8 is supplied to the gate of the thyristor 7 to permit a charge stored in the capacitor 4 to be applied to the ignition coil 5. As a result, an ignition voltage is produced in the secondary coil 5*b* to cause the ignition plug 6 to spark.

When the operation result of the output a of the signal coil 8 is applied to the gate of the thyristor 7 even in the engine speed lower than the No (500 rmp), the rotational speed of the crank extremely changes due to ignition failure or the like. As a result, the capacitor 4 is discharged by the operation result of not the output b of the signal coil produced at the required ignition timing but the output a. This results in irregular combustion and difficulty of the engine start. In the above-mentioned embodiment, in the engine speeds lower than the No, by keeping the OFF state of the transistor 261, the operation result is not applied to the gate of the thyristor 7, and only the signal H produced at the ignition position required by the engine is applied to the gate of the thyristor 7. Therefore, a correct and stable ignition timing is obtained.

The above-mentioned embodiment uses as an operation input to the negative-going sensing circuit 26 the output voltage 250 of the F-V circuit 25 which is not affected by the engine speed variation and produces a DC voltage proportional to the engine speed and not the output signal a of the signal coil 8 directly related to the engine speed variation. Therefore, an undesirable situation is preventable in which a great variation of an angular speed in the low engine speeds abnormally increases the output a of the signal coil 8 thereby to operate the negative-going sensing circuit 26. Further, since the ignition timing is free from a variation of the output signal from the signal coil 8, the ignition characteristic of the engine in the low engine speed region is remarkably improved.

The above-mentioned embodiment may change the conduction voltage of the transistor 261 by changing the resistance of the variable resistor 413. Because of this feature, a change of the Vro value due to a change of the F-V output voltage 413 may readily be adjusted by changing the resistance of the variable resistor 413. No is readily set in any advance angle characteristic.

As described above, when the engine first runs at the engine speed higher than the N2, the ignition occurs at a falling point of the operation result of the operation circuit 21 having the output voltage a of the signal coil 8 as its input, that is, the output voltage E, and the ignition timing is positioned at least in advance of the position S of the zero advance angle required by the engine. Further, in a state that the engine speed falls below the number of revolutions, when the ignition fails by some cause but the running of the engine is kept, the output signal b of the delayed angle side of the signal coil 8, not the operation result of the operation circuit 21, is used for the reignition thereby to obtain an advance angle characteristic as shown in FIG. 13.

In brief, in the low speed region where a variation of the engine speed or an angular speed is great over each cycle, ignition is made not by the electrical operation result by a simple electrical signal mechanically fixed. Further, when the engine speed is lower than No, the operation result of the operation circuit 21 is not applied to the gate of the thyristor 7 whereby the much reliable ignition is ensured in the low engine speed region.

Figure 14:
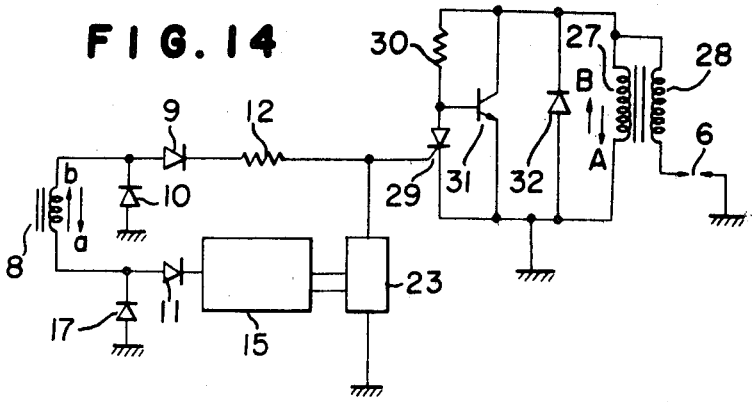
FIG. 14 is a circuit diagram of a magnet ignition device of the current shut-off type which employs the embodiment shown in FIG. 8.

In addition to the magnet ignition device of the CDI type mentioned above, the invention is applicable for a magnet ignition device of the current shut-off type as shown in FIG. 14.

In FIG. 14, reference numeral 27 designates a power source coil used also as the ignition primary coil. Numeral 28 represents the ignition secondary coil. A thyristor 29 is connected in series with the power source coil via the resistor 30 and is connected at the gate to both output terminals of the signal coil 8. A transistor 31 is connected at the base to a connection point between the resistor 27 and the anode of the thyristor 29, at the collector to one end of the power source coil 27, and at the emitter to the other end of the power source coil 27. A diode 32 is connected at the cathode to one end of the power source coil 27 and at the anode to the other end of the power source coil 27.

In this example, the output signal in a B1 direction of the power source coil 27 causes current to flow into the transistor 28 via the resistor 27, so that the transistor 31 is conductive and a larger current flows through the power source coil. Then, at the ignition time of the engine, the operated signal of the output signal a from the signal coil 8 and the output signal b are applied to the thyristor 29, thereby to render the thyristor 29 conductive. With this, the passage current of the power source coil 27 abruptly reduces. As a result of the abrupt change, a high voltage is induced in the ignition secondary coil 28, so that the ignition plug 6 is sparked. On the other hand, the output signal in the direction A is shortcircuited by the diode 32 and therefore it does not contribute to the ignition.

Figure 15:
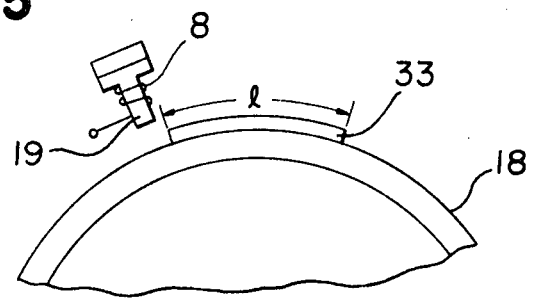
FIG. 15 is a front view of one embodiment of an angular position detecting device.
Figure 16:
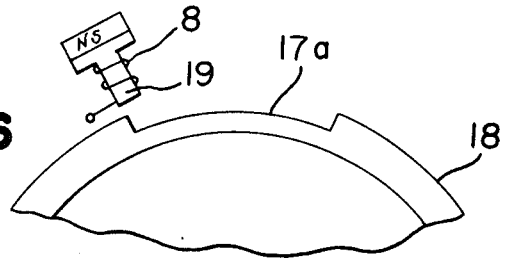
FIGS. 16 and 17 are front views of other embodiments of the angular position detecting device.
Figure 17:
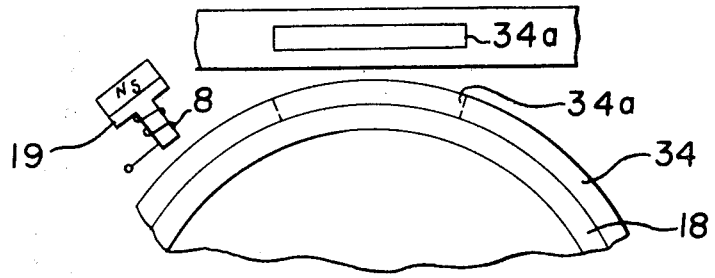

In this embodiment, when the rotational frequency of the crankshaft is higher than N2, the output signal a of the signal coil 8 is earlier applied to the thyristor 29 to effect the ignition while, when it is lower than N2, the output b is the engine speeds exceeding N0, as in the first embodiment. Further, in either high or low speed, the conduction signals are continuously applied to the thyristor 26. However, the first signal applied reduces the passage current of the power source coil 24, so that, even if the later signal is applied to the thyristor 26, the passage current in the power source coil 27 does not change, so that no ignition voltage is produced in the secondary ignition coil 28. Additionally, in the engine speeds lower than N0, since the OFF state of the transistor 261 is kept, the operation result is not applied to the thyristor 7, only the output b of the signal coil 8 is applied to the gate of the thyristor 7 to contribute the ignition thereby prevent the irregular combustion and poor engine start. The device for causing the signal coil 8 to produce an angular signal employed in the above-mentioned embodiments has the iron plates 17 each with a given peripheral length l, mounted onto the periphery of the flywheel 18 as shown in FIG. 15. Some alternatives are allowable in the invention, however. In an example shown in FIG. 16, a cut-away portion **17*a* is formed on the periphery of the flywheel 18. In another example shown in FIG. 17, a ring 34 is fitted around the outputer periphery of the flywheel 18 and a cut-away portion 34*a* as a magnetic modulating portion is formed on the periphery of the ring 34. The same effects as those obtained by the above-mentioned embodiments also are attainable when those alaternatives are used. In place of two magnetic modulating portions such as iron plates 33 attached onto the outer periphery of the flywheel 18**, a single magnetic modulating portion may also be used.

Figure 18:
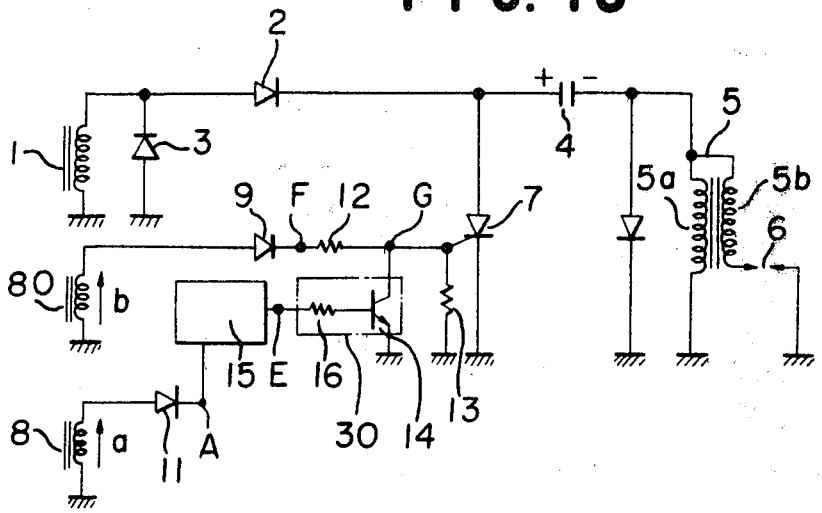
FIG. 18 is a circuit diagram of an additional embodiment of the ignition device according to the present invention.

Yet another embodiment of the present invention will be described referring to FIGS. 18 to 23. In FIG. 18 illustrating a magnet ignition device of the CDI type, a signal coil for producing an ignition signal as a first angular position detector produces a first angular signal a corresponding to a given angular position of the crankshaft of an engine in synchronism with the rotation of the engine. A signal coil 80 for producing an ignition signal as a second angular position detector produces a second angular signal b with a wide angular width corresponding to the crank position delayed by $\theta$ from an angular position where the first angular signal a is produced.

Figure 19:
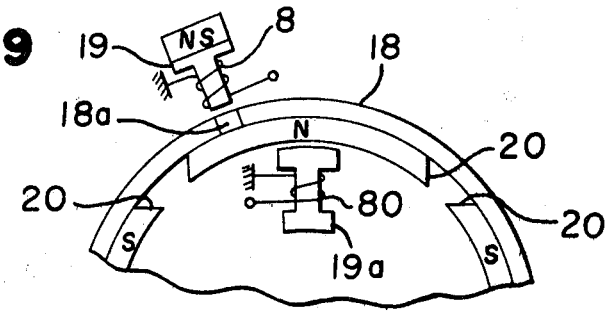
FIG. 19 is a front view of major part of the structure of the angular position detecting device shown in FIG. 18.

Turning now to FIG. 19, there is shown a s uctutre of a device for detecting first and second angular position. In the figure, a flywheel 18 is shaped like a magnet generator with a plurality of permanent magnets fixed on the inner surface of the flywheel 18. These permanent magnets 20 are juxtaposed with different polarities one another. Two magnetic modulating sections as holes or notches are equiangularly provided along the peripheral portion of the flywheel 18. The angular width of the magnetic modulating section **18*a* is narrower than the corresponding one of the permanent magnets. a stator core 19 with a signal coil 8 wound therearound is disposed facing the flywheel 18 with a clearance therebetween. The stator core 18 induces a signal voltage in the signal coil 8 through a change of the relative position thereof to the magnetic mdodulating sections 18*a* with the rotation of the flywheel 18. A second stator core 19*a* wound by a signal coil 80 is disposed facing the permanent magnet 20 with a clearance therebetween. Through the rotation of the permanent magnet 20 by the rotation of the flywheel 18, it induces a signal voltage with a wider angular width than that by the signal coile 8 in the signal coil 80**.

Figure 20:
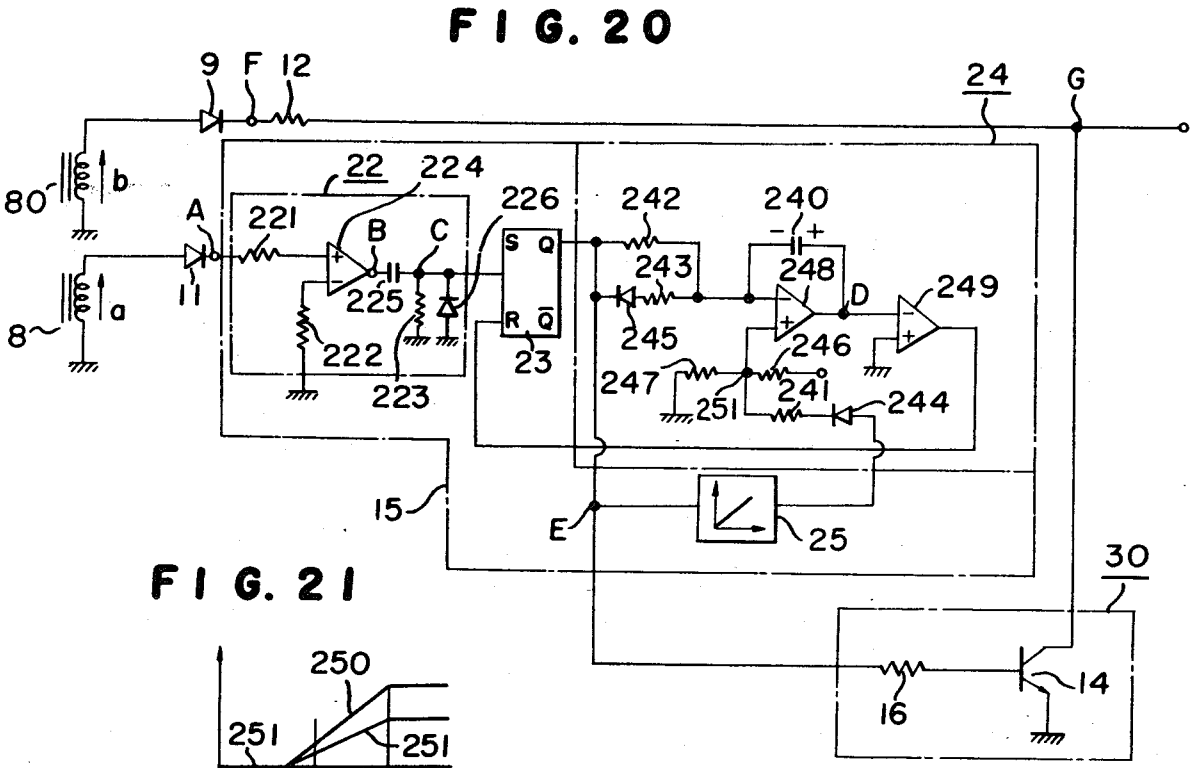
FIG. 20 is circuit diagram of a detailed circuit construction of the embodiment shown in FIG. 18.

FIG. 20 shows a circuit diagram of the ignition timing operation circuit 15. In the figure, reference numeral 22 designates a wave shaping circuit for waveshaping the output signal from the signal coil 8; 24 an operation circuit connected to the flip-flop circuit 23 to produce a given output signal in accordance with the number of revolutions of the engine; 25 a rotational frequency to voltage converting circuit (referred to as an F-V circuit) for receiving the output signal a from the signal coil 8 as an engine speed signal to convert it into a DC voltage proportional to the rotational frequency.

Figure 21:
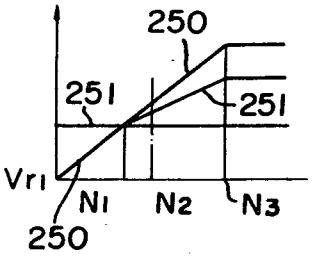
FIG. 21 is a graphical representation of an output caracteristic of the F-V circuit shown in FIG. 19.

FIG. 21 shows an output characteristic of the F-V circuit 25. The characteristic exhibits a rectilinear change as indicated by reference numeral 250. Further, the characteristic has the voltage Vr1 at the N2 equal to the bias voltage of the opeamp 248. Accordingly, the (+) terminal voltage of the opeamp 248 changes like a characteristic curve 251.

Figure 22:
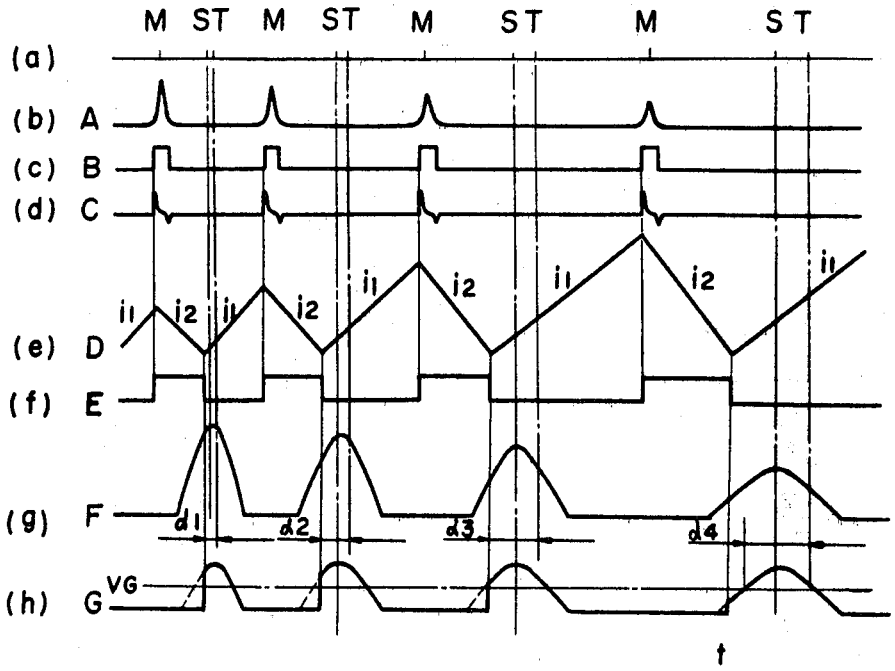
FIG. 22 is a set of waveforms which are useful in explaining the operation of the embodiment shown in FIG. 15.

FIG. 22 shows output waveforms at points A to G in the circuit shown in FIG. 20, in which abscissa represents time while the ordinate represents voltage. In the figure, (a) represents an angular position of a crankshaft of the engine in which M is an angular position advanced relative to the most advanced angular position required by the engine where a first angular signal b is produced. S stands for an angular position where an second angular signal g is produced. T denotes a top dead point of the engine.

Figure 23:
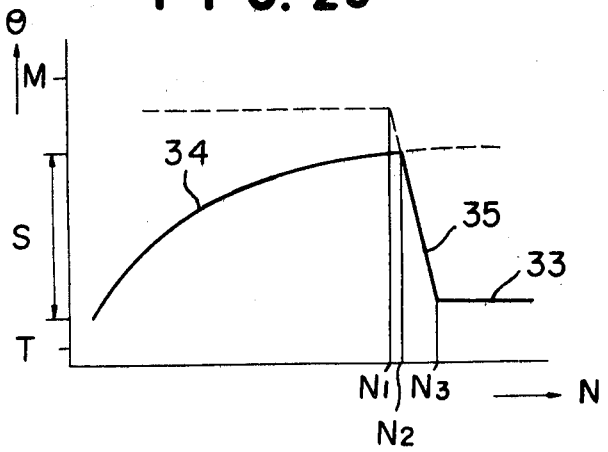
FIG. 23 is a graphicaly representation of an advance angle caracteristic of the embodiment shown in FIG. 15.

The conduction time control of the thyristor 7, or the control of the ignition timing, in the above-mentioned embodiment will be described referring to FIG. 23 depicting the ignition timing characteristic.

Assume now that the engine runs at a fixed engine speed lowr than N2 but higher than N3 shown in FIG. 23, and that the ignition advance angle is not zero but alpha in advance of the position T.

The F-V circuit 25 counts or integrates the output voltage corresponding to the rotational number of the engine. The output voltage thereof is higher than the bias voltage Vr1. The output voltage 250 becomes an input voltage to the opeamp 248. The (+) terminal voltge 251 of the opeamp 248 changes rectilinearly with increase of the rotational number.

The flip-flop circuit 23 is set by the leading edge of the output voltage G in the angular position M of the engine to produce the output voltage of high level. When the output voltage E becomes high in level, the capacitor 240 with the polarity as shown starts discharge with a current i2 as given below $i2$ = High level output voltage E of the flip-flop 23 − (+) terminal voltage 251 of the opeamp/resistance of the resistor 242 (15)

As seen from the above equation, the magnitude of the discharge current i2 depends on the (+) terminal voltage 251 of the opeamp 248 if the resistance of the resistor 242 is fixed and eventually it depends on the output voltage 250 of the F-V circuit 25. In other words, with increase of the rotational number of the engine, the discharge current i2 becomes small, so that the inclination of the output voltage D of the operational amplifier 248 is gentle and the angular width of the high level output voltage E of the flip-flop 23 is narrower. The angular width of the output voltage E thus obtained corresponds to the operation result of the operation circuit 24.

Then, upon the commencement of the discharge of the capacitor 240, the output voltage D of the opeamp 248 descends as shown in FIG. 22. And when it reaches zero voltage, the comparator 249 produces a positive pulse voltage which in turn is applied as a reset input signal to the flip-flop 23.

The flip-flop circuit 23 is reset when it receives the reset pulse at the input terminal 1R and its output voltage E becomes low in level.

When the output voltage E of the flip-flop circuit 23 becomes low in level, the capacitor 240 shown in FIG. 20 is charged again with a current i1 with a polarity as shown and given below $i1$ = (+) terminal voltage 251 of the opeamp − voltage drop of the diode 245/resistance of the resistor 243 + (+) terminal voltage of the opeamp 248/resistance of the resistor 242 16

The above equation indicates that the magnitude of the current i1 depends on the (+) terminal voltage 251 of the opeamp 248 of the resistances of the resistors 243 and 242 are constant, and eventually it depends on the output voltage 250 of the F-V circuit 23. Therefore, the charging current i1 increases with the increase of the engine speed and the inclination of the output voltage D of the opeamp 248 becomes steep. As described above, in this engine speed region, with increase of the engine speed, an angular width of the high level output voltage E of the flip-flop 23 becomes wider.

The output voltage E of the operation circuit obtained is applied to the base of the transistor 14 through the resistor 16. Upon receipt of the output voltage, the transistor 14 conducts for duration of the high level of the output voltage E to bypass the output signal b of the signal coil 10, that is, part of the voltage as denoted as G in FIG. 22, so that the gate signal of the thyristor 7 take a waveform of G in FIG. 22.

Thus, in the engine speeds within N1 to N3, with increase of the engine speed, the falling timing of the output voltage E of the flip-flop 23 gradually delays. Accordingly, the conduction timing of the thyristor 7 delays, so that the ignition timing is delayed as the engine speed increases. When the engine speed reaches N3, the output voltage 250 of the F-V circuit 25 and the (+) terminal voltage 251 of the opeamp 248 are fixed, so that the charging and discharging currents i1 and i2 of the capacitor 240 are constant independently of the number of revolutions. As a result, the falling or negative-going timing of the output voltage E of the flip-flop 23 is fixed irrespective of increase of the number of revolutions. Accordingly, the ignition timing of the engine is delayed and then is constant as shown in FIGS. 23 and 33.

The operation of the ignition device in the engine speeds lower than N2 but higher than N1 will be described. Also in this engine speed region, the operation result of the operation circuit 15 in accordance with the rotation of the engine, that is, the negative-going timing of the output voltage E of the flip-flop 23 changes with the rotation of the engine. At this time, the output voltage b (F shown in FIG. 22) of the signal coil 10 does not yet reach the trigger voltage $V_G$ of the thyristor 7 while the output voltge E of the flip-flop E is high in level, as illustrated at the right hand portion of FIG. 22 G. The operation result of the operation circuit 15 does not contribute to the control of the ignition timing. Accordingly, in the engine speed region, the conduction time of the thyristor 7 is speed region, the conduction time of the thyristor 7 is controlled by only the output voltage waveform b with a wide angualr width of the signal coil 80, so that the advance angle characteristic as shown in FIG. 23 is obtained. The reason for this is that the output voltage with a wide angular width of the signal coil 80 grows with the increase of the rotation and therefore its angular speed to reach the trigger voltage $V_G$ of the thyristor 7 for the top dead point T is fast.

The operation of the operation circuit 15 in the engine speeds lower than $N_1$ will be described. In this engine speed region, as seen from FIG. 21, the charge and discharge currents $i_1$ and $i_2$ of the capasitor 240 is constant irrespect of the engine speed because the output voltage 250 of F-V circuit 25 is lower than the bias voltage $Vr_1$. Accordingly, the angular width from high level to low level of the output voltage E from the flip-flop circuit 23 is constant irrespect of the engine speed in this engine speed region. As previously descrived, in the engine speed region the output voltage b (G shown in FIG. 22) of the signal coil 80 never reaches the conduction voltage $V_G$ of the thyristor 7 while the output voltage E is at high level, so that even in this engine speed region the ignition timing is phase-advanced by the growth of the output voltage of the signal coil 80. The advance angle characteristic is advanced with the increase of the engine speed as shown in FIGS. 23 and 24.

As seen from the foregoing description of the operation, in the region where the engine speed reaches $N_1$, the falling time of the output voltage E of the operation circuit 24 from high level to low level is constant. Further, since the falling time ranges till the output voltage of the signal coil 80, or the output voltage at the point G reaches the trigger voltage $V_G$, the ignition timing is advanced with the increase of the engine speed, as indicated by a curve 34 in FIG. 23, caused by the growth of the output voltage waveform of the signal coil 80. In the region ranging from $N_1$ to $N_2$, the falling time gradually delays, but the output voltage G is still bellow the trigger voltage $V_G$, so that the ignition timing is advanced with the increase of the engine speed, as indicated by a curve 34 in FIG. 23, caused by the growth of the output voltage waveform of the signal coil 80, as in the previous case. In the region where the engine speed reaches $N_2$ and further increases to reach $N_3$, the angular width of the high level output voltage E gradually narrows, as indicated $\alpha_3$ to $\alpha_1$, from the top dead point T, as shown in FIG. 22. As a result, the falling time delays with the increase of the engine speed and the bypassing period of the output voltage from the signal coil 80 enlongates, so that the ignition timing delays with the increase of the engine speed as indicated by a curve 35 in the FIG. 23.

Further, in the engine speeds higher than $N_3$, the falling time is constant, with the result that the ignition timing is settled down fixed while being delayed.

The advance angle characteristic of the ignition timing may be properly set if the output voltage waveform of the signal coil 80 and the like are changed as required. The delay characteristic 35 and the fixed angle 33 may also be set if the output voltage characteristic 251 is changed as required by changing the output voltage 250 of the F-V circuit 25 or the bias voltage $Vr_1$.

In case where the operation circuit fails or the engine requires no delay characteristics 35 and 33, only the waveform advance characteristic 34 is applicable to the ignition timing if the operation circuit 24 and the control circuit 30 are electrically disconnected. Accordingly the engine speed increases above $N_2$ to enable the ignition of the engine.

What is claimed is:

1. A magnet ignition device comprising a power source which produces positive and negative output signals in synchronism with rotation of an engine, rectifies the output signals, and applies the rectified signals into an ignition coil;

a switching element for controlling the current passage of said ignition coil;

a first angular position detecting device for producing in synchronism with the rotation of said engine a first angular signal corresponding to a given crank angle position of said engine;

a second angular position detecting device for producing in synchronism with the rotation of said engine a second angular signal supplied directly to said switching element, which second angular signal corresponds to a crank angular position delayed by a given angle relative with respect to said given angular position where said first angular signal is produced and said second angular signal has a wider angular width than that of said first angular signal;

an ignition timing operation circuit which starts its operation by establishing a reference position in response to the occurrence of said first angular signal to compute an ignition timing in accordance with a running condition of the engine regardless of the amplitude and shape of said first angular signal; and a control circuit for bypassing said second angular signal by a signal obtained by the operation result of said ignition timing operation.

2. A magnet ignition device comprising a power source which produces positive and negative output signals in synchronism with the rotation of an engine, rectifies the output signals, and applies the rectified signals into an ignition coil;

a switching element for controlling the current passage of said ignition coil;

a single angular position detecting device for producing in synchronism with the rotation of said engine a first angular signal with one polarity corresponding to a given crank angular position of said engine and a second angular signal with a polarity opposite the polarity of said first angular signal and supplied directly to said switching element, which second angular signal corresponds to a crank angular position delayed by a given angle relative to an angular position where said first angular signal is produced;

an ignition-timing operation circuit including a frequency-voltage converter circuit for producing a DC voltage in accordance with the number of revolutions the engine and; an ignition timing means which starts its operation by establishing a reference position in response to the occurrence of the output voltage of said frequency-voltage converter circuit and said first angular signal to compute an ignition timing in accordance with a running condition of the engine regardless of the amplitude and shape of said first angular signal; and a negative-going detecting circuit for supplying a signal obtained by the operation result of said ignition timing operation circuit to said switching element only when the engine speed of said engine is higher than a given value.

3. A magnet ignition device according to claim 2, wherein said negative-going detecting circuit including, a control element which supplies the output of said ignition-timing operation circuit into said F-V frequency-voltage converter circuit when the engine speed of said engine is lower than a given value; a semiconductor switching element which conducts in response to the output of said operation circuit when the engine speed is higher than said given value to drive said switching element; and a variable resister which adjusts the conduction voltage of said semiconductor switching element, whereby when the engine speed of said engine is higher than a given value, the signal obtained by the operation result of said ignition timing operation circuit is applied as an ignition signal to said switching element and when the engine speed is lower than a given value, a second angular signal is applied as the ignition signal to said switching element.

* * * * *